United States Patent [19]

Kyushima et al.

[11] Patent Number: 4,881,008

[45] Date of Patent: Nov. 14, 1989

[54] PHOTOMULTIPLIER WITH PLURAL PHOTOCATHODES

[75] Inventors: Hiroyuki Kyushima; Kimitsugu Nakamura; Takahito Kato, all of Shizuoka, Japan

[73] Assignees: Hamamatsu Photonics Kabushiki Kaisha, Shizuoka; Research Development Corporation of Japan, Tokyo, both of Japan

[21] Appl. No.: 182,517

[22] Filed: Apr. 18, 1988

[30] Foreign Application Priority Data

Apr. 18, 1987 [JP] Japan ..... 62-95874

[51] Int. Cl.[4] ..... H01J 43/10

[52] U.S. Cl. ..... 313/532; 313/533; 313/539; 313/540

[58] Field of Search ..... 313/532, 533–536, 313/539, 540, 530, 541, 544

[56] References Cited

U.S. PATENT DOCUMENTS 3,668,388 6/1972 Fischer et al. ..... 313/533 X 4,117,366 9/1978 Davis ..... 313/536 X

FOREIGN PATENT DOCUMENTS 0019445 11/1982 Japan ..... 313/532

*Primary Examiner*—Donald J. Yusko
*Assistant Examiner*—Michael Horabik
*Attorney, Agent, or Firm*—Finnegan, Henderson, Farabow, Garrett and Dunner

[57] ABSTRACT

A photomultiplier with plural photocathodes comprising a rectangular end face plate, plural photocathodes arranged on the end face plates at predetermined intervals in the longitudinal direction of the end face plate, plural focusing electrodes assigned to the photocathodes respectively, plural dynodes provided in common for all of the photocathodes, and plural anode electrodes assigned to the photocathodes respectively, each of the dynodes having plural electron emitting parts for emitting secondary electrons and insulating parts for preventing the secondary electrons emitted from any one of the electron emitting parts from straying into the other electron emitting parts.

8 Claims, 3 Drawing Sheets

2,3,4,5
10,11,12,13
30,31,32,33
R3
D
C

PHOTOMULTIPLIER WITH PLURAL PHOTOCATHODES

BACKGROUND OF THE INVENTION

This invention relates to a photomultiplier employed in a scintillation detector to detect radiation such as gamma rays, and more particularly to a photomultiplier for detecting the incident position of radiation.

There has been conventionally known a photomultiplier used in a scintillation detector to detect the incident position of radiation such as gamma rays.

FIG. 1(A) is a sectional front view showing a photomultiplier employed in a conventional scintillation detector, and scintillators combined suitably with the photomultiplier to emit light in response to the incidence of radiation such as gamma rays. FIG. 1 (B) is a sectional side view of the scintillation detector shown in FIG. 1(A). As shown in FIGS. 1(A) and 1(B), the scintillators 101 and 102 and the photomultiplier 103 constitute the scintillation detector 100.

The scintillators 101 and 102 are made of light emitting material such as bismuth germanium oxide ($Bi_4Ge_3O_{12}$). When radiation such as gamma rays are applied to the scintillators 101 and 102, the latters 101 and 102 emit light beams 420 nm (nano-meters) in wavelength. Each of the light beams thus emitted is converted into an electrical signal by the photomultiplier 103 which is so positioned as to receive the light beams. The position determination of the incident beam to the scintillators 101 and 102 is performed by detecting which of the anodes OT, and $OT_2$ of the photomultiplier 103 outputs a pulse current.

The photomultiplier 103 has two photocathodes 104 and 105 which face the two scintillators 101 and 102, respectively, thereby determining which of the scintillators 101 and 102 has received the radiation. The photocathodes 104 and 105 are provided on inner surfaces 108 and 109 of a transparent end face plate 107, respectively, which forms the bottom of a rectangular cylinder-shaped air-tight tube 106.

The photomultiplier 103 has two focusing electrodes 110 and 111, two arrays of dynodes 112 through 118 and 120 through 126, and two mesh anode electrodes 127 and 128 in correspondence to the two photocathodes 104 and 105. Therefore, upon reception of light, the photocathode 104 emits photoelectrons, which are multiplied by means of the dynodes 112 through 118 and output through the anode electrode 127. Similarly, upon reception of light, the photocathode 105 emits photoelectrons, which are multiplied by means of the dynodes 120 through 126 and outputted through the anode electrode 128.

The focusing electrodes 110 and 111 are used to positively introduce the photoelectrons from the photocathodes 104 and 105 to the respective arrays of dynodes 112 through 118 and 120 through 126. The focusing electrodes 110 and 111 have parts 129 and 130 adjacent to each other, respectively. The part 129 serves as a partition wall for preventing the photoelectrons emitted from the photocathode 104 from being applied to the arrays of dynodes 120 through 126, and similarly the part 130 serves as a partition wall for preventing the photoelectrons emitted from the photocathode 105 from being applied to the array of dynodes 112 through 118.

The dynodes 112 through 118, and 120 through 126 are curved as required and supported on electrical insulation supporting members 131 and 132.

As shown in FIG. 1(A), the sections of the inner surfaces 108 and 109 of the end face plate 107 which is perpendicular to the longitudinal direction of the dynodes 112 through 118, and 120 through 126 (i.e., perpendicular to the surface of the drawing the FIG. 1(A), and accordingly the sections of the photocathodes 104 and 105 have a predetermined curvature (a radius of curvature R1), and have the centers on the central axes A—A and B—B of the focusing electrodes 110 and 111, respectively. Similarly, as shown in FIG. 1(B), the sections of the inner surfaces 108 and 109 of the end face plate 107, which is perpendicular to the longitudinal direction of the dynodes 112 through 118, and 120 through 126, and accordingly the sections of the photocathodes 104 and 105 have a predetermined curvature (a radius of curvature R2) and have their centers of curvature on the central axes A—A and B—B of the focusing electrodes 110 and 111, respectively.

In the scintillation detector 100 containing the photomultiplier 103 thus constructed, a gamma ray $\gamma 1$ is incident to the scintillator 101 to emit scintillation light. Of the light thus emitted, light beams advancing along optical paths are typically designated by e11 and e12 as shown in FIG. 1(A) respectively. The light beam e11 is incident directly to the photocathode 104 of the photomultiplier 103 to emit a photoelectron P11 therefrom. On the other hand, the light beam e12, after being reflected by the side wall of the scintillator 101, is incident to the photocathode 104 of the photomultiplier 103 to emit a photoelectron P12 therefrom.

The photoelectrons P11 and P12 emitted from the photocathode 104, being focused owing to the configuration in section (R1 and R2) of the photocathode 104 and by the focusing electrode 110, are applied to the first dynode 112. The photoelectrons are multiplied by the dynodes 112 through 118, thus being outputted as a pulse current through the output terminal OT1 of the anode electrode 127.

The pulse currents provided at the output terminals OT1 and OT2 of the anode electrodes 127 and 128 are applied to a pulse counter (not shown), so that the number of pulses corresponding to the gamma rays $\gamma 1$ (or $\gamma 2$) incident to the scintillator 101 (or 102) can be detected. That is, the pulse counter is used to detect how many pulse currents are supplied through either of the output terminals $OT_1$ and $OT_2$, thereby to determine how many gamma rays are incident to either of the scintillators 101 and 102.

In the conventional photomultiplier 103, as shown in FIGS. 1(A) and 1(B), the wall 129 of the focusing electrode 110 prevents the photoelectrons emitted from the photocathode 104 on one side from being applied to the first dynode 120 on the other side, and similarly the wall 130 of the focusing electrode 111 prevents the photoelectrons emitted from the photocathode 105 on the other side from being applied to the first dynode 112 on the one side. However, the conventional photomultiplier is disadvantageous for the following reasons: The two inner surfaces 108 and 109 of the end face plate 107 have the predetermined radius of curvature and are adjacent to each other, so that the plate 107 is larger in thickness at the border between the two photocathodes 104 and 105. Therefore, a part of the light emitted in the scintillator on one side (for instance 101) may advance towards the photocathode on the other side (for instance 105) instead of the photocathode 104 when passing near the border between the two inner surfaces 108 and 109 of the end face plate 107. That is, so-called "light mixing" occurs in the photomultiplier, as a result of which the incident position is erroneously detected.

On the other hand, there has been a strong demand for the provision of a method of improving the accuracy of detection of the incident position of radiation such as gamma rays in the art. In order to meet this requirement, a variety of scintillation detectors have been proposed in the art. In a first example of the scintillation detectors, a number of photomultipliers having a small end face plate and a small photocathode are arranged with high concentration. In a second example, the photomultiplier shown in FIGS. 1(A) and 1(B) is so modified that the photocathodes are further divided.

However, in the first example of the conventional scintillation detectors in which a number of small photomultipliers are arranged with high concentration, miniaturization of the photomultiplier with its characteristic maintained unchanged is limited. Furthermore, the ratio of the outside dimension of the photomultiplier to that of the photocathode is so relatively large that a part of the light from the scintillator may enter the gap between the adjacent photocathodes. That is, the light cannot be effectively utilized and accordingly it is difficult to greatly improve the accuracy of detection of the incident position of radiation.

In the second example of the conventional scintillation detectors containing the photomultiplier as shown in FIGS. 1(A) and 1(B) which is modified in such a manner that the photocathodes are further divided, the problem "light mixing" has not been solved yet, and therefore it is limited to perform the position detection with the high accuracy. Furthermore, it is necessary to provide the arrays of dynodes and the anode electrodes the numbers of which correspond to the number of division of the photocathodes, with the result that the detector is unavoidably intricate in construction and is not suitable for miniaturization.

Accordingly, an object of the invention is to provide a photomultiplier small in size and simple in construction which can be improved in the accuracy of detection of the incident position of radiation such as gamma rays.

SUMMARY OF THE INVENTION

The foregoing object of the invention has been achieved by the provision of a photomultiplier comprising: a rectangular end face plate; a plurality of photocathodes provided on the end face plate in such a manner that the photocathodes are arranged at predetermined intervals in the longitudinal direction of the end face plate; a plurality of focusing electrodes which are assigned to the photocathodes, respectively; a plurality of dynodes provided in common for all of the photocathodes; and a plurality of anode electrodes provided for the photocathodes, respectively, the rectangular end face plate being uniform in thickness in the longitudinal direction thereof and curved with a predetermined curvature in a direction perpendicular to the longitudinal direction, each of the dynodes having a plurality of electron emitting parts provided respectively for the photocathode, in such a manner that the electron emitting parts are isolated from one another by isolating means.

In the photomultiplier according to the invention, a light beam incident to a certain point on the rectangular end face plate is applied through the end face plate to the corresponding one of the photocathodes provided on the end face plate in the longitudinal direction thereof. Since the rectangular end face plate is uniform in thickness in the longitudinal direction, the light beam is always incident to the corresponding photocathode. Upon reception of the light beam, the photocathode emits photoelectrons. The photoelectrons thus emitted are focused by the corresponding focusing electrode so as to be impinged on the corresponding electron emitting part of the first of the dynodes provided in common for all the photocathodes. In this operation, the photoelectrons are effectively focused because each photocathode is curved with the predetermined curvature in the direction perpendicular to the longitudinal direction of the end face plate. The photoelectrons emitted from the photocathode are impinged on the electron emitting part of the first dynode which is provided for that photocathode, as a result of which the electron emitting part emits secondary electrons. The electron emitting parts of the array of dynodes including the first dynode, are isolated from one another by the isolating means, so that the photoelectrons emitted from a photocathode are allowed to reach the respective anode electrode while being multiplied by the electron emitting parts of the dynodes. That is, the light beam incident to the photocathode can be obtained as a pulse current at the respective anode electrode with the photoelectrons and secondary electrons being not staggered to any electron emitting parts other than the corresponding ones.

DETAILED DESCRIPTION OF THE INVENTION

Preferred embodiments of this invention will be described hereinunder with reference to the accompanying drawings.

Figure 1B:
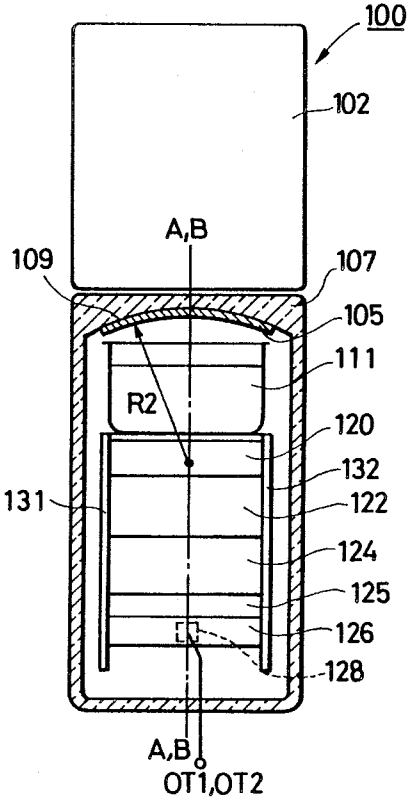
FIG. 1(A) is a sectional front view showing a conventional scintillation detector, and the FIG. 1(B) is a sectional side view of the scintillation detector shown in FIG. 1(A)
Figure 1A:
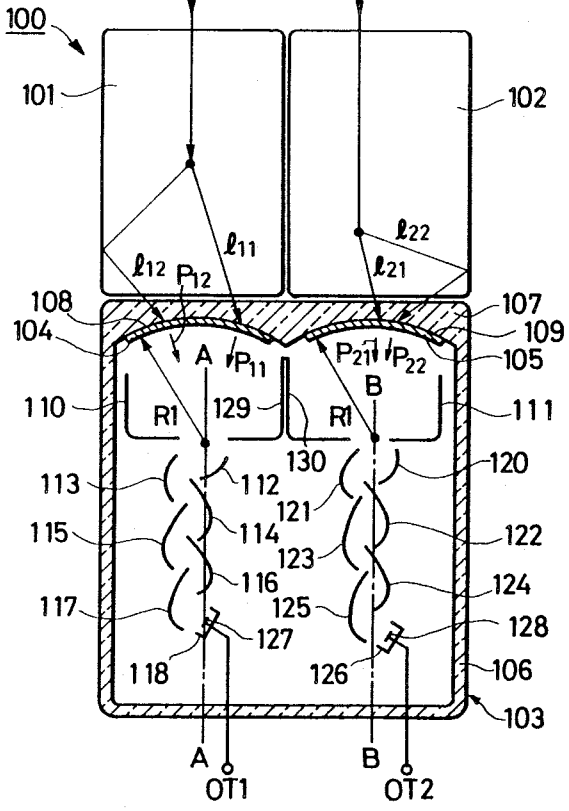
Figures 2A, 2B:
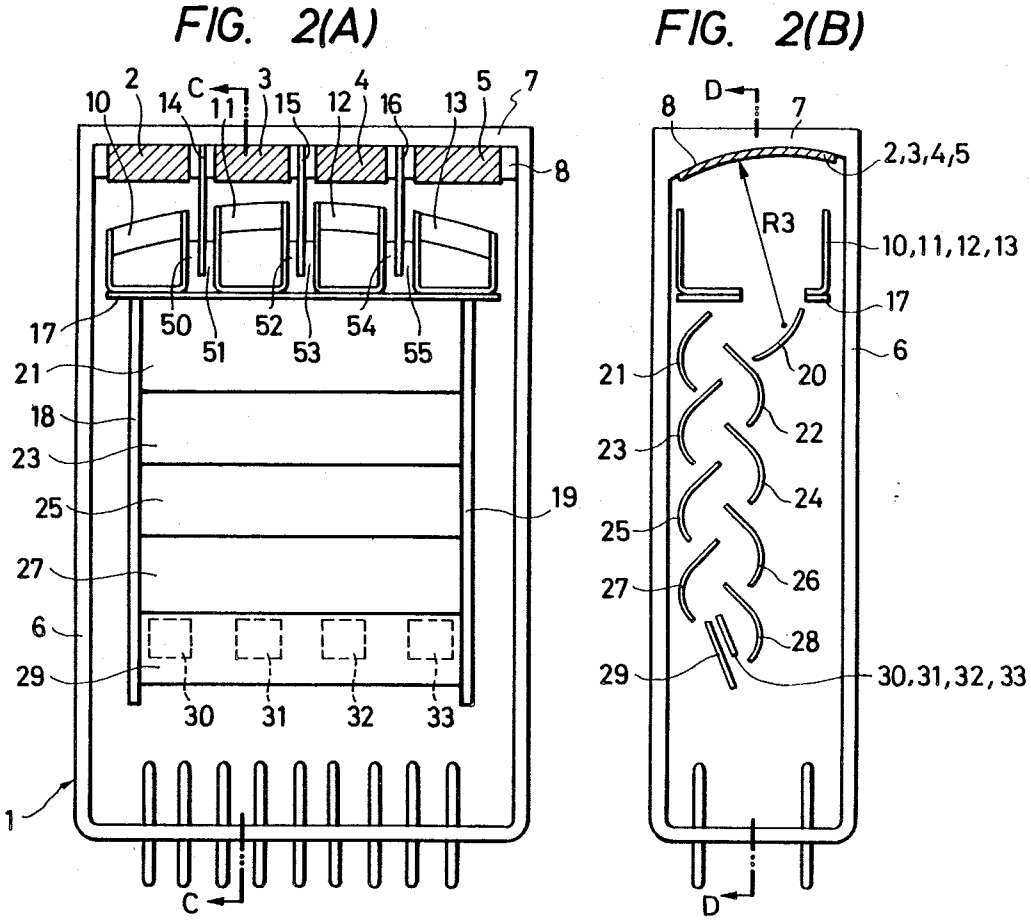
FIG. 2(A) is a vertical sectional view showing a first example of a photomultiplier according to this invention.
FIG. 2(B) is a sectional view taken along line C—C in FIG. 2(A).

FIG. 2(A) is a vertical sectional view of a first example of a photomultiplier according to the invention; and FIG. 2(B) is a sectional view taken along line C—C in FIG. 2(A).

As shown in FIGS. 2(A) and 2(B), the photomultiplier 1 has four photocathodes 2, 3, 4 and 5. These photocathodes 2 through 5 are arranged at predetermined intervals on the inner surface 8 of a rectangular transparent end face plate 7 which is the top plate of a rectangular-cylinder-shaped air-tight tube. The end face plate 7 is curved with a predetermined radius of curvature R3 in a direction perpendicular to the direction (or longitudinal direction) in which the photocathodes 2 through 5 are arranged, in such a manner that the center of the curvature of the inner surface of the end face plate 7 is shifted from the central axis D—D of the photomultiplier towards a first dynode 20.

The photomultiplier 1 further comprises: four focusing electrodes 10 through 13, respectively, in correspondence to the four photocathodes 2 through 5; the first through tenth dynodes 20 through 29 provided in common for all the photocathodes 2 through 5; and four anode electrodes 30 through 33, respectively, in correspondence to the four photocathodes 2 through 5.

Partition walls 14, 15 and 16 are provided between the photocathodes 2, 3, 4 and 5 and between the focusing electrodes 10, 11, 12 and 13, respectively, so that photoelectrons emitted from any one of the photocathodes 2 through 5 are prevented from straying into the focusing electrodes other than the corresponding focusing electrode. The upper ends of the partition walls 14, 15 and 16 are closely contacted with the inner surface of the plate 7, and the lower end portions of the partition walls are secured through spacers 50, 51, 52, 53, 54 and 55 to the focusing electrodes 10 through 13. Since the focusing electrodes 10 through 13 are coupled through the spacers 50 through 55 to the partition walls 14 through 16 as described above, the focusing electrodes 10 through 13 are arranged at the same intervals as the photocathodes 2 through 5.

A conductive substrate 17 is coupled to a pair of supporting members 18 and 19 of electric insulating material such as ceramic, between which first through tenth dynodes 20 through 29 are mounted. In order that the first through tenth dynodes 20 through 29 are used in common for the four photocathodes 2, 3, 4 and 5, these dynodes 20 through 29 are so arranged that the longitudinal direction of each of the dynodes 20 through 29 (that is, the direction perpendicular to the surface of the drawing of FIG. 2(B)) is in parallel with the longitudinal direction of the rectangular end face plate 7.

Figure 3:
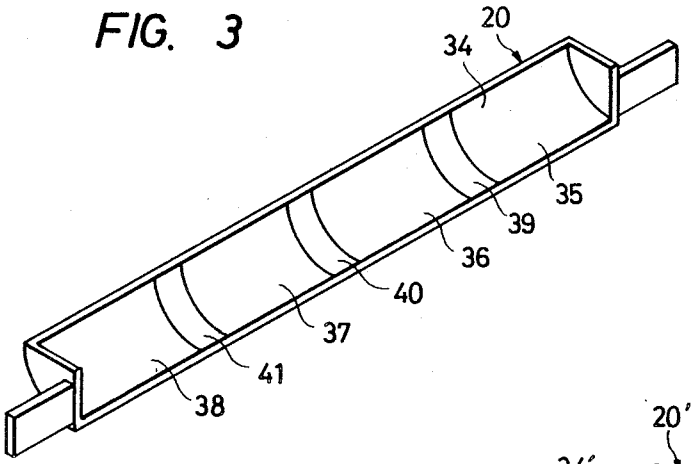
FIG. 3 is a perspective view shown in the first dynode in the photomultiplier shown in in FIG. 2.

The first example of the photomultiplier according to the invention uses the first dynode 20 as shown in FIG. 3. Electron emitting parts 35 through 38 having a predetermined secondary electron emitting ratio are formed on the inner wall 34 of the first dynode 20 at positions corresponding to those of the photocathodes 2 through 5, respectively, and belt-shaped parts 39, 40 and 41 of material lower in secondary electron emitting ratio (larger in work function) are formed on the inner wall at position corresponding to those of the partition walls 14, 15 and 16, respectively. The remaining second through tenth dynodes 21 through 29 have the same electron emitting parts and belt-shaped parts as the first dynode 20; however, it should be noted that the dynodes 21 through 29 are so shaped that their sections are as shown in FIG. 2 (B) i.e., the dynodes operate suitably at the positions. The provision of the belt-shaped parts 39, 40 and 41 between the electron emitting parts 35, 36, 37 and 38 prevents the movement of secondary electrons emitted from any one of the electron emitting parts to the adjacent electron emitting part or parts in each of the first through tenth dynodes 20 through 29 so that secondary electrons emitted by the electron emitting parts 35, 36, 37 and 38 are positively directed to the anode electrodes 30, 31, 32 and 33 which are provided in correspondence to the photocathodes 2, 3, 4 and 5, respectively.

Figure 5:
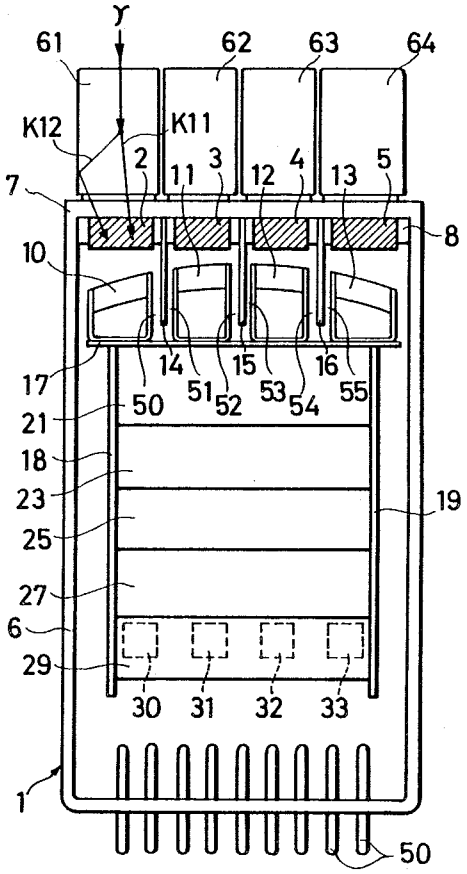
FIG. 5 is a diagram showing a scintillation detector comprising scintillators and the photomultiplier shown in FIGS. 2(A) and 2(B).

In the case where the photomultiplier thus constructed is applied to a scintillation detector as shown in FIG. 5, four scintillators 61, 62, 63 and 64 are arranged on the end face plate 7 of the photomultiplier 1 so that the scintillators 61, 62, 63 and 64 face the photocathodes 2, 3, 4 and 5, respectively, and predetermined voltages are applied through stem pins 50 and lead wires (not shown) to the photocathodes 2 through 5, the focusing electrodes 10 through 13, the first through tenth dynodes 20 through 29 and the anode electrodes 30 through 33 by an external circuit (not shown).

When gamma rays are incident to one of the four scintillators 61 through 64, for instance the scintillator 61, scintillation light is emitted from the scintillator 61. Of the light thus emitted, light beams advancing along optical paths are typically designated by k11 and k12 in FIG. 5. The light beam k11 is incident directly to the plate 7 of the photomultiplier 1, while the light beam k12, after being reflected by the side wall of the scintillator 61, is incident to the plate 7. In this operation, since the plate 7 is small and uniform in thickness in the longitudinal direction, the light beams k11 and k12 emitted from the scintillator 61 are positively incident to the photocathode 2 provided for the scintillator 61; that is, the probability that the light beams k11 and k12 emitted from the scintillator 61 stray into the photocathode 3 corresponding to the scintillator 62 adjacent thereto is greatly reduced.

Similarly, the probability that light beams emitted from the scintillator 62 stray into the corresponding photocathode 2 to the scintillator 61 adjacent thereto is lowered; that is, the light beams emitted from the scintillator 62 can be positively applied to the photocathode 3 provided for the scintillator 62.

When a light beam from one of the scintillators (for instance the scintillator 61) is incident to the corresponding photocathode (for instance the photocathode 2), the photocathode 2 emits photoelectrons. The photoelectrons thus emitted, being focused by the focusing electrode 10, are impinged on the electron emitting part 35 of the first dynode 20. Since the partition wall 14 is disposed between the photocathodes 2 and 3 and between the focusing electrodes 10 and 11, the photoelectrons emitted from the photocathode 2 will not go to the focusing electrode 11. The partition wall 14 further serves to prevent photoelectrons from straying from the focusing electrode 11 to the focusing electrode 10. The photoelectrons focused by the focusing electrode 10 with the aid of the radius of curvature of the inner surface 8 of the end face plate 7; i.e., the radius of curvature of the photocathode 2, are impinged to the electron emitting part 35 of the first dynode 20. Some of the photoelectrons may be impinged to the border between the electron emitting parts 35 and 36. In this case, secondary electrons emitted from the border may go to the adjacent electron emitting parts of the second dynode 21. However, as described above, the belt-shaped part 39 having a low secondary electron emission ratio is provided between the electron emitting parts 35 and 36, and therefore even if photoelectrons are impinged on the belt-shaped part 39, no secondary electrons will be emitted thereby.

Since the adjacent electron emitting parts are isolated from each other by the belt-shaped part as described above, the secondary electrons emitted from the electron emitting part 35 of the first dynode 20 can be positively impinged on the corresponding electron emitting part of the second dynode 21, and are effectively prevented from going to the adjacent electron emitting part. Similarly, the secondary electrons emitted from the electron emitting part 36 adjacent to the electron emitting part 35 of the first dynode 20 can be prevented from going to the electron emitting part of the second dynode 21 which corresponds to the electron emitting part 35 of the first dynode 20.

The same belt-shaped parts are formed on the second through tenth dynodes 21 through 29. Therefore, photoelectrons applied to any one of the electron emitting parts of the first dynode 20 will reach the corresponding anode electrode through the corresponding electron emitting parts of the remaining dynodes while being multiplied.

For instance, radiation incident to the scintillator 61 provided for the photocathode 2 can be positively outputted as a pulse current through the corresponding anode electrode 30. In other words, the scintillation detector according to the invention is free from the disadvantage that radiation incident to the scintillator 61 is erroneously outputted as a pulse current not only through the anode electrode 30 but also through the other anode electrodes 31, 32 or 33.

The photoelectrons emitted from the photocathodes 3, 4 and 5 are incident to the electron emitting parts 36, 37 and 38 of the first dynode 20, respectively. In this operation, because the belt-shaped parts 40 and 41 having a small secondary electron emission ratio are provided between the electron emitting parts 36, 37 and 38 so that the latter 36, 37 and 38 are isolated from one another as described above, similarly as in the above-described case the mixing of photoelectrons can be prevented. That is, the photoelectrons emitted from the photocathodes 3, 4 and 5 can be positively allowed to reach the respective anode electrodes 31, 32 and 33.

Figure 4:
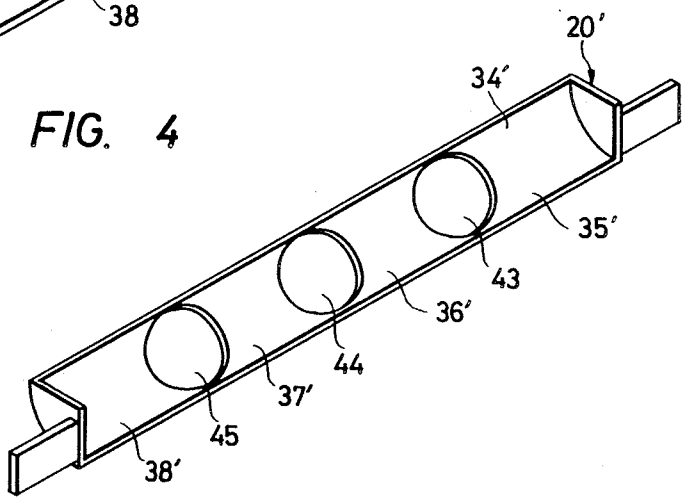
FIG. 4 is a perspective view showing the first dynode in a second example of the photomultiplier according to the invention.

A second example of the photomultiplier according to the invention employs the first dynode 20' as shown in FIG. 4 which is different from the first dynode 20 of the first example. The first dynode 20' has electron emitting parts 35', 36', 37' and 38' having a predetermined secondary electron emission ratio on the inner surface 34' at positions corresponding to those of the photocathodes 2, 3, 4 and 5, respectively; and separating walls 43, 44 and 45 of metal at positions corresponding to the partition walls 14, 15 and 16, respectively. The second through tenth dynodes have the same electron emitting parts 35' through 35' and separating walls 43 through 45 as the first dynodes 20': However, it should be noted that the second through tenth dynodes are so shaped that their sections are as indicated at 21 through 29 in FIGS. 2(A) and 2(B). The separating walls 43 through 45 are vertically formed on the inner wall 34' of the first dynode 20', for instance, by press forming.

The second example of the photomultiplier according to the invention is the same in construction as the first example except for the dynodes. Therefore, its entire arrangement is not shown, and its detailed description will be omitted.

In the second example of the photomultiplier, photoelectrons emitted from one of the photocathodes, for instance the photocathode 2, are impinged on the corresponding electron emitting part 35' of the first dynode 20'. However, some of the photoelectrons tend to go to the border between the electron emitting parts 35' and 36'. As described above, in the second example, the separating wall 43 is provided between the electron emitting parts 35' and 36', and therefore the photoelectrons impinged on the border between the parts 35' and 36' are prevented from entering the adjacent part 36' by means of the separating wall 43. The secondary electrons emitted by the electron emitting part 35' are prevented from going to the adjacent electron emitting part 36' of the second dynodes 21' by means of the separating wall 43 of the first dynode and the corresponding separating wall of the second dynode 21'. Thus, the separating walls effectively isolate the electron emitting parts of the dynodes from one another; that is, they can positively prevent the mixing of photoelectrons in the adjacent electron emitting parts. Accordingly, the secondary electrons emitted from the electron emitting part 35' of the first dynode 20' in response to the photoelectrons applied thereto are allowed to reach the corresponding anode electrode through the corresponding electron emitting parts by means of the separating walls while being multiplied.

Similarly, photoelectrons impinged on the electron emitting part 36', 37' or 38' of the first dynode 20' are allowed to positively reach the corresponding electron emitting part 36', 37' or 38' of the following dynode by means of the separating walls 44 and 45. On the other hand, secondary electrons emitted from the electron emitting part 36', 37' or 38' of the first dynode 20' are allowed to reach the respective anode electrode through the corresponding electron emitting parts by means of the separating walls 44 and 45 of the first dynode 20' and those of the remaining dynodes while being multiplied.

As is apparent from the above description, radiation incident to one of the scintillators (not shown) are positively detected as a pulse current provided at the corresponding anode electrode. That is, the scintillation detector according to the invention is free from the disadvantage that the pulse current is outputted from the anode electrode other than the corresponding anode electrode.

As described above, in the first and second examples of the photomultiplier according to the invention, the end face plate 7 on which the photocathodes are formed is thin and uniform in thickness in the longitudinal direction, and therefore light beams from one of the scintillators can be allowed to positively reach the corresponding photocathode without staggering to the other photocathodes.

Isolating means having a small secondary electron emission ratio, namely, the belt-shaped parts or the separating walls are provided on the dynodes which are provided in common for the photocathode, so that photoelectrons emitted from any one of the photocathodes and secondary electrons emitted from the dynodes' electron emitting parts which are provided for the photocathode are allowed to positively reach the respective anode electrode while being isolated between the electron emitting parts of the dynodes. Although, as described above, the dynodes are provided in common for all the photocathodes, the mixing of secondary electrons between the electron emitting parts is prevented. Therefore, the photomultiplier of the invention is much smaller both in the number of dynodes and in the number of lead wires than the conventional photomultiplier 103. In the photomultiplier of the invention, not only the photocathode but also the electron emitting parts are isolated from one another, and therefore in response to radiation incident to a scintillator the pulse current can be positively obtained at the respective anode, with the result that the incident position can be detected with higher accuracy.

FIGS. 3 and 4 shows the line type dynodes; however, box-and-grid type dynodes or circular gage type dynodes may be employed instead of the line type dynodes.

Further, the first and second embodiments according to this invention were described hereinbefore with the respective numbers of the photocathodes, the focusing electrodes, the anode electrodes, the electron emitting parts, etc. being typically set to four. However, this invention is not limited to that number, and the numbers of those components may be below or above four.

As described above, in the photomultiplier according to the invention, the rectangular end face plate is uniform in thickness in the longitudinal direction and is curved with the predetermined curvature in the direction perpendicular to the longitudinal direction, and the electron emitting parts isolated from one another by the isolating means are formed on each of the dynodes in correspondence to the photocathode, so that a light beam incident to an arbitrary position on the end face plate in response to the application of radiation such as gamma rays can be accurately obtained as a pulse current at the respective anode electrode, thereby to accurately detect incident position. Furthermore, in the photomultiplier of the invention, the dynodes are provided in common for all the photocathodes; therefore, the photomultiplier can be simplified in construction and miniaturized as much.

What is claimed is:

1. A photomultiplier for converting an incident light in to an amplified electrical signal, said photomultiplier comprising:

an air-tight enclosure having at the bottom thereof an end face plate for receiving the incident light, said end face plate being uniform in thickness in the longitudinal direction thereof;

a plurality of photocathodes provided on an inner surface of said end face plate, for converting the incident light into photoelectrons;

a plurality of dynodes of multiplying said photoelectrons, provided in common for all of said photocathodes;

a plurality of focusing electrodes provided between said photocathodes and said dynodes, for converging said photoelectrons into said dynodes; and a plurality of anode electrodes assigned to said photocathodes respectively, for converting multiplied photoelectrons into electrical signals, each of said dynodes having on an inner wall thereof a plurality of electron emitting parts for emitting secondary electrons in response to said photoelectrons and a plurality of isolating parts for preventing said secondary electrons emitted from one of said electron emitting parts from straying into the other electron emitting parts, each of said isolating parts provided between adjacent electron emitting parts.

2. A photomultiplier as claimed in claim 1, wherein said photocathodes are arranged at predetermined intervals in the longitudinal direction of said end face plate.

3. A photomultiplier as claimed in claim 1, wherein said end face plate is in the rectangular form.

4. A photomultiplier as claimed in claim 3, wherein said end face plate is curved with a predetermined curvature in a direction perpendicular to said longitudinal direction.

5. A photomultiplier as claimed in claim 1, wherein each of said isolating parts comprises a belt-shaped part having a lower secondary electron emission ratio than that of said electron-emitting parts.

6. A photomultiplier as claimed in claim 1, wherein each of said isolating parts comprises a separting wall of metal projecting from said inner wall.

7. A photomultiplier as claimed in claim 1, wherein said photomultiplier further comprises a plurality of partition walls for preventing photoelectrons emitted from any one of said photocathodes from straying into the focusing electrodes other than the corresponding focusing electrode, each of said partition walls extends from a position between adjacent photocathodes to another position between adjacent focusing electrodes facing said adjacent photocathodes, respectively.

8. A photomultiplier as claimed in claim 7, wherein said photomultiplier further comprises plural spacers provided between respective adjacent focusing electrodes, and wherein the upper end of each partition wall is closely contacted with said inner surface of said end face plate, and the lower end thereof is secured through each of said spacers to said focusing electrodes.

* * * * *